US006734799B2

(12) United States Patent
Munch

(10) Patent No.: US 6,734,799 B2
(45) Date of Patent: May 11, 2004

(54) APPARATUS AND METHOD FOR RESPONDING TO THE HEALTH AND FITNESS OF A DRIVER OF A VEHICLE

(75) Inventor: Carl A. Munch, Troy, MI (US)

(73) Assignee: TRW Inc., Lyndhurst, OH (US)

( * ) Notice: Subject to any disclaimer, the term of this patent is extended or adjusted under 35 U.S.C. 154(b) by 86 days.

(21) Appl. No.: 09/796,957

(22) Filed: Mar. 1, 2001

(65) Prior Publication Data

US 2002/0121981 A1 Sep. 5, 2002

(51) Int. Cl.[7] ..... G08B 23/00

(52) U.S. Cl. ..... 340/576; 340/575; 340/449; 340/459; 340/471; 340/439; 340/539; 340/531; 340/870.05; 340/435

(58) Field of Search ..... 340/576, 575, 340/449, 459, 471, 439, 539, 531, 870.05, 435

(56) References Cited

U.S. PATENT DOCUMENTS

| | | | | |
|---|---|---|---|---|
| 4,439,824 A | | 3/1984 | Mayer | 364/150 |
| 4,665,385 A | * | 5/1987 | Henderson | 340/539 |
| 4,909,260 A | * | 3/1990 | Salem et al. | 128/721 |
| 5,033,000 A | | 7/1991 | Littlejohn et al. | 364/424.05 |
| 5,465,079 A | | 11/1995 | Bouchard et al. | 340/576 |
| 5,488,353 A | * | 1/1996 | Kawakami et al. | 340/576 |
| 5,499,182 A | | 3/1996 | Ousborne | 364/424.05 |
| 5,521,580 A | | 5/1996 | Kaneko et al. | 340/439 |
| 5,574,426 A | * | 11/1996 | Shisgal et al. | 340/435 |
| 5,574,641 A | | 11/1996 | Kawakami et al. | 364/424.05 |
| 5,653,462 A | | 8/1997 | Breed et al. | 280/735 |
| 5,758,299 A | | 5/1998 | Sandborg et al. | 701/29 |
| 5,801,763 A | | 9/1998 | Suzuki | 348/77 |
| 5,805,079 A | * | 9/1998 | Lemelson | 340/870.05 |
| RE35,920 E | | 10/1998 | Sorden et al. | 342/457 |
| 5,829,782 A | | 11/1998 | Breed et al. | 280/735 |
| 5,901,978 A | | 5/1999 | Breed et al. | 280/735 |
| 5,942,979 A | | 8/1999 | Luppino | 340/576 |
| 6,060,989 A | * | 5/2000 | Gehlot | 340/576 |

* cited by examiner

*Primary Examiner*—Daniel J. Wu
*Assistant Examiner*—Tai T. Nguyen
(74) *Attorney, Agent, or Firm*—Tarolli, Sundheim, Covell & Tummino L.L.P.

(57) ABSTRACT

An apparatus (10) helps protect an occupant (1) of a vehicle (100). The apparatus (10) includes first means (11) for non-intrusively sensing at least one health condition of the vehicle occupant (1) and for producing a first output signal (110) indicative of the health condition of the vehicle occupant (1). The apparatus (10) further includes 2ND means (21) for transmitting a health condition signal derived from the first output signal (110) to a person at a location remote from the vehicle (100) to convey health condition information to the person and to enable the person to determine a suitable type of response.

21 Claims, 6 Drawing Sheets

| THE USE OF ASSESSMENT IN VARIOUS DRIVING ENVIRONMENTS | | | | |
|---|---|---|---|---|
| | DRIVING ENVIRONMENTS | | | |
| PROFILES: | STOPPED | URBAN | SUBURBAN | HIGHWAY |
| THROTTLE | YES | YES | YES | YES |
| SPEED | NA | NO | ? | YES |
| CLOSURE | NA | YES | YES | YES |
| DISTANCE | NA | YES | YES | YES |
| MARGIN | NA | NO | NO | YES |
| STEERING | NA | NO | ? | YES |
| TURN SIGNAL | NO | YES | YES | YES |
| SEC. TASK | NO | NO | NO | YES |
| BLINKS | YES | YES | YES | YES |

Fig.4

APPARATUS AND METHOD FOR RESPONDING TO THE HEALTH AND FITNESS OF A DRIVER OF A VEHICLE

BACKGROUND OF THE INVENTION

1 Field of the Invention

The present invention relates to an apparatus and method for helping to protect an occupant of a vehicle and, more particularly, determining whether a driver of the vehicle is fit to operate the vehicle.

2 Description of Related Art

There is a continuing increase in the density of vehicles traveling the world's roadways. This increase raises the probability of vehicles colliding with objects. Simultaneously, a need to improve the safety of vehicle operations, as it currently stands, by reducing the occurrences of vehicles colliding with stationary and moving objects (such as roadside obstacles and other vehicles) is present. One means for reconciling these competing factors includes monitoring the relative speed, direction of travel, and distance between vehicles sharing the roadway, and to use such information to provide direct indications to the driver of the vehicle of potential danger. It is known for automotive engineers to use microwave radar systems as a means to monitor and warn drivers of such environmental conditions.

Another means for reconciling these factors is to evaluate a driver's operational performance over time to determine if the driver has lost the capability of operating the vehicle safely. Whenever a driver is responsible for operating a motor vehicle, it is critical that the driver be capable of demonstrating basic cognitive and motor skills at a level that will assure the safe operation of the vehicle. A number of conditions can impair a driver's ability to perform the basic cognitive and motor skills that are necessary for the safe operation of a motor vehicle. For example, consumption of alcohol or narcotic drugs, or lack of sleep, can make it impossible for a driver to react appropriately to a potentially hazardous situation with sufficient speed and skill to avoid danger to the driver, the vehicle, other people (i.e., passengers, pedestrians, etc.), other vehicles and their occupants, and property that might be in a potential zone of danger at any given time. Therefore, it is very important to continuously evaluate a driver's ability to identify hazardous conditions and react to those conditions while operating a motor vehicle.

A number of electronic devices are known that record data on various aspects of vehicle performance and/or environment information. These devices primarily function as trip recorders, storing information such as trip distance, trip time, miles per gallon consumed, and average speed.

It would be desirable to have an apparatus and method which utilizes the information that is gathered by a radar system and other sensors, and the information that has been recorded during past trips and/or a present trip, to evaluate not only a driver's operational performance, but also the driver's health condition (i.e., breathing, heart rate, etc.), in real-time and under actual conditions. It would also be desirable for such an apparatus and method to predict when a driver is near the point of being unfit, whether it be because of a medical condition or other reason, to safely operate a vehicle and determine exactly when the driver is actually unfit to safely operate a vehicle. Thus, a conclusion that a driver's health condition and/or operational performance is unacceptable may be communicated to a remote person, the driver, and/or the vehicle itself in order that one or all of these take appropriate action to mitigate or correct the potential or actual danger of this situation.

SUMMARY OF THE INVENTION

In accordance with the present invention, an apparatus helps protect an occupant of a vehicle. The apparatus includes first means for non-intrusively sensing at least one health condition of the vehicle occupant and for producing a first output signal indicative of the health condition of the vehicle occupant. The apparatus further includes first means for transmitting a health condition signal derived from the first output signal to a person at a location remote from the vehicle to convey health condition information to the person and to enable the person to determine a suitable type of response.

BRIEF DESCRIPTION OF THE DRAWINGS

The foregoing and other features of the present invention will become apparent to those skilled in the art to which the present invention relates upon reading the following description with reference to the accompanying drawings, in which:

FIG. 4 is a table illustrating the use of assessments by the controller of FIG. 1 in various driving environments of the vehicle;

DESCRIPTION OF PREFERRED EMBODIMENT

Figure 1:
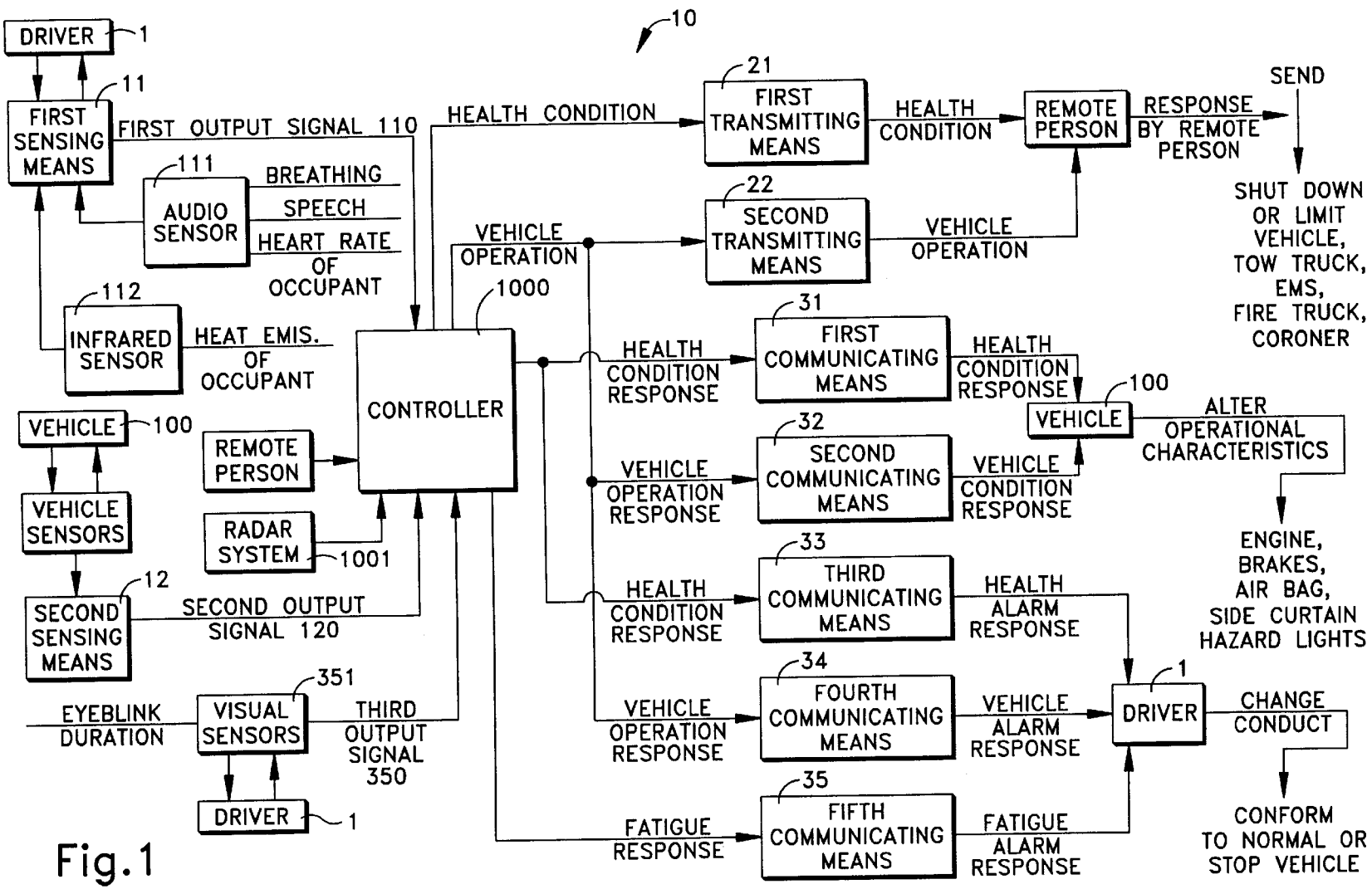
FIG. 1 is a simplified block diagram of the apparatus and method of the present invention.

The present invention is an apparatus and method for helping to protect an occupant of a vehicle and, more specifically, for determining whether a driver 1 of a motor vehicle 100 is fit to operate the motor vehicle. The fitness of the driver 1 is determined by utilizing various factors including the health condition of the driver, the past/current driving performance of the driver, the awareness of the driver, and/or a predetermined set of performance parameters. An apparatus 10 in accordance with the present invention may operate, for example, as a stand alone system in which information is dynamically gathered for determining the fitness of the driver 1 of the vehicle 100 to operate the vehicle. Alternatively, the apparatus 10 may operate in cooperation with an obstacle detection and collision avoidance system and an operational event recording system.

Generally, the apparatus 10 monitors the driver 1 of the vehicle 100 and the operation of the vehicle over time in order to determine if either the driver or vehicle goes outside a predetermined norm or displays some other erratic activity. When the abnormal/erratic activity is found, the apparatus 10 may automatically send detailed information about the activity and/or a simple alert to a multitude of receivers.

Specifically, the apparatus 10 includes first sensing means 11, second sensing means 12, an electronic controller 1000, first transmitting means 21, second transmitting means 22, first communicating means 31, second communicating means 32, third communicating means 33, fourth communicating means 34, and fifth communicating means 35. All of these elements may be disposed within the vehicle 100.

The first sensing means 11 non-intrusively senses at least one health condition of the driver 1 of the vehicle 100 and produces a first output signal 110 indicative of the health condition of the driver 1. The first sensing means 11 may include an audio sensor 111 and a heat emission sensor 112.

The audio sensor 111 senses auditory output from the driver 1 such as the driver's breathing pattern, the driver's speech pattern, and/or the driver's heart rate pattern over time. The audio sensor 111 may, for example, include a piezoelectric element that produces an electric voltage in response to vibrations produced in the air by sound.

The driver's breathing pattern may be indicative of a health condition which is impairing, or will impair, the driver's ability to safely operate the vehicle 100 (i.e., short shallow breathes may indicate an occurring heart attack). The controller 1000 can intermittently compare the driver's breathing pattern to the driver's normal breathing pattern recorded by the controller or to a predetermined normal breathing pattern that has been programmed into the controller and is non-specific to any individual driver. The comparison will reveal whether the driver's breathing pattern is abnormal and possibly indicative of a health condition that is impairing, or will impair, the driver's ability to safely operate the vehicle 100.

The driver's speech pattern may be indicative of a health condition that is impairing, or will impair, the driver's ability to safely operate the vehicle 100 (i.e., slurred speech may indicate an occurring stroke). The controller 1000 can intermittently compare the driver's speech pattern to the driver's normal speech pattern recorded by the controller or to a predetermined normal speech pattern that has been programmed into the controller and is non-specific to any individual driver. The comparison will reveal whether the driver's speech pattern is abnormal and possibly indicative of a health condition that is impairing, or will impair, the driver's ability to safely operate the vehicle 100.

The driver's heart rate pattern may be indicative of a health condition that is impairing, or will impair, the driver's ability to safely operate the vehicle 100 (i.e., an erratic heart rate may indicate an occurring heart attack). The controller 1000 can intermittently compare the driver's heart rate pattern to the driver's normal heart rate pattern recorded by the controller or to a predetermined normal heart rate pattern that has been programmed into the controller and is non-specific to any individual driver. The comparison will reveal whether the driver's heart rate pattern is abnormal and possibly indicative of a health condition that is impairing, or will impair, the driver's ability to safely operate the vehicle 100.

The heat emission sensor 112 senses infrared output from the driver 1 in order to determine the body temperature of the driver. The heat emission sensor 112 may, for example, include at least one infrared projection unit and/or at least one infrared reception unit.

The body temperature of the driver 1 may be indicative of a health condition which is impairing, or will impair, the driver's ability to safely operate the vehicle 100 (i.e., an extremely high body temperature may indicate that the driver is on the verge of fainting). The controller 1000 can intermittently compare the driver's body temperature to the driver's normal body temperature recorded by the controller or to a predetermined normal body temperature that has been programmed into the controller and is non-specific to any individual driver. The comparison will reveal whether the driver's body temperature is abnormal and possibly indicative of a health condition that is impairing, or will impair, the driver's ability to safely operate the vehicle 100.

The first transmitting means 21 transmits a health condition signal derived from the first output signal 110 by the controller 1000 to a person at a location remote from the vehicle 100 to convey health condition information to the remote person and to enable the remote person to determine a suitable type of response. For example, if the driver's breathing pattern and/or heart rate pattern indicate that the driver 1 is having a heart attack, the remote person may dispatch an EMS unit as well as a tow truck to the location of the vehicle 100. The first transmitting means 21 may, for example, include an oscillator such as a Gunn diode, a directional coupler, a receive coupler, a Schottsky diode mixer, a microwave antenna, and/or a RF load.

The second sensing means 12 intermittently senses operational characteristics of the vehicle 100 and produces a second output signal 120 indicative of those characteristics. The second sensing means 12 may include sensors for sensing a wide range of operational and environmental conditions.

For example, a speed sensor may be coupled to the drive train of the vehicle 100 for sensing the speed of the vehicle 100. A steering wheel position sensor, such as a dual Hall-effect device, may sense the location of a magnet located on the steering wheel shaft that determines the position of the steering wheel. A tachometer may be coupled to the engine and may sense the number of revolutions per minute of the engine. A pressure gauge may sense the engine oil pressure. A thermometer may sense the temperature of the engine oil, the engine block, the transmission fluid (if the vehicle 100 uses any such fluid), and/or the temperature of the engine coolant.

Accelerometers may sense the rate of horizontal acceleration in the direction of forward motion, the direction of rearward motion, and/or at right angles to the direction of forward/rearward motion. Inclinometers may sense the attitude of the vehicle 100 with respect to the gravitational field of the earth. A sensor may sense activation of an anti-lock braking system and/or an air bag. Pressure sensors may sense the amount of pressure being applied to the accelerator and/or brake pedals and the air pressure in each tire. A sensor may sense which, if either, of the right or left vehicle turn signals is active. An external thermometer may sense the temperature outside the vehicle 100. A sensor may sense when the windshield wipers are active.

This list of sensors is not intended to be exhaustive, nor is each output from each of these particular sensors utilized under all situations. These sensors produce output that the controller 1000 may use to determine the operational conditions under which the driver 1 and vehicle 100 are operating over time.

The above operational and environmental characteristics of the vehicle 100 may be indicative of a condition that has impaired the driver's ability to operate the vehicle (i.e., intoxication, emotional instability, or a health condition not detected by the first sensing means 11). The controller 1000 can develop a profile of the driver's operation of the vehicle 100 over time that can be compared to a previously recorded normal operational profile of the driver 1 or a general profile that is non-specific to any individual driver. The profile may be stored in an Event Recording Apparatus (ERA) 1005. The comparison will reveal whether the driver's recent operation of the vehicle 100 presents a hazard to the driver 1, the vehicle 100, and/or objects external to the vehicle. Excessive vehicle speed, engine revolutions, and/or braking may be indicative of real and/or potential hazardous operation of the vehicle 100.

The second transmitting means 22 transmits a vehicle operation signal derived from the second output signal 120 by the controller 1000 to a person at a location remote from the vehicle 100 to convey vehicle operation information to the person and to enable the person to, along with the health condition signal, determine a suitable type of response. For example, if a sensor indicates the actuation of an air bag, the remote person may dispatch an EMS unit as well as a tow truck.

The second transmitting means 22 may, for example, include an oscillator such as a Gunn diode, a directional coupler, a receive coupler, a Schottsky diode mixer, a microwave antenna, and/or a RF load. Alternatively, the second transmitting means 22 and the first transmitting means 21 may comprise a single device that receives a single signal containing both health condition information and vehicle operation information and transmits the single signal derived therefrom to the remote person.

The controller 1000 analyzes the health condition signal derived from the first output signal 110 of the first sensing means 11 and determines whether the operational characteristics of the vehicle 100 should be altered due to the driver's health condition. If the controller 1000 determines that certain operational characteristics of the vehicle 100 should be altered, the first communicating means 31 communicates a health condition response signal from the controller 1000 to the vehicle 100 and alters the operational characteristics of the vehicle in response to the health condition response signal. The first communicating means 31 may, for example, include various control devices for controlling operation of the vehicle 100 and a hardwire connection between the controller 1000 and those control devices. The control devices may include an ignition cut-off switch, a brake activation switch, an air bag actuation switch, a side curtain actuation switch, an external hazard lights activation switch, and/or a steering lock mechanism. For example, the controller 1000 determines if a hazard exists and, if it does, sends an activation signal to some or all of the above control devices.

The controller 1000 also analyzes the vehicle operation signal derived from the second output signal 120 of the second sensing means 12 and determines whether the operational characteristics of the vehicle 100 should be altered due to the driver's operation of the vehicle over time. If the controller 1000 determines that certain operational characteristics of the vehicle 100 should be altered, the second communicating means 31 communicates a vehicle operation response signal from the controller 1000 to the vehicle 100 and alters the operational characteristics of the vehicle in response to the vehicle operation response signal. The second communicating means 31 may, for example, include the above control devices for controlling operation of the vehicle 100 and the hardwire connection between the controller 1000 those control devices. The control devices may include the above ignition cut-off switch, brake activation switch, air bag actuation switch, side curtain actuation switch, external hazard lights activation switch, and/or steering lock mechanism, as described above. For example, the controller 1000 determines if a hazard exists and, if it does, sends an activation signal to some or all of the above control devices.

The controller 1000 analyzes the health condition signal derived from the first output signal 110 of first sensing means 11 and determines whether the driver 1 should be warned concerning the driver's health condition. If the controller 1000 determines that the driver 1 should be warned, the third communicating means 33 communicates a health alarm response signal to the driver 1 and informs the driver that the health condition of the driver requires a change in conduct by the driver. The third communicating means 33 may, for example, include various health alarm devices and a hardwire connection between the controller 1000 and those health alarm devices. The health alarm devices alert the driver 1 that a condition is occurring to the driver that places the driver at a high level of medical risk and impairs, or is about to impair, the driver's ability to operate the vehicle 100. The health alarm devices may include a visual warning device such as a dashboard "Health Alarm" light being illuminated or flashing, an auditory warning device such as a horn sounding off, and/or a tactile warning device such as a mechanism for vibrating the steering wheel, vehicle seat, and/or accelerator pedal.

The controller 1000 analyzes the vehicle operation signal derived from the second output signal 120 of the second sensing means 12 and determines whether the driver 1 should be warned concerning the driver's operation of the vehicle 100. If the controller 1000 determines that the driver 1 should be warned, the fourth communicating means 34 communicates a vehicle operation alarm response signal to the driver 1 and informs the driver that the operation of the vehicle 100 over time requires a change in conduct by the driver. The third communicating means 33 may, for example, include various operational alarm devices and a hardwire connection between the controller 1000 and those operational alarm devices. The operational alarm devices alert the driver 1 that the driver is placing the driver and the vehicle 100 at a high level of risk and the driver's ability to safely operate the vehicle is, or is about to be, impaired. The operational alarm devices may include a visual warning device such as a dashboard "Operational Alarm" light being illuminated or flashing, an auditory warning device such as a horn sounding off within the vehicle 100, and/or a tactile warning device such as a mechanism for vibrating the steering wheel, vehicle seat, and/or accelerator pedal.

The controller 1000 analyzes a third output signal 350 from a visual sensor 351 that detects the eye blink duration of the driver 1 and determines whether the driver should be warned concerning the driver's possible fatigue level. If the controller 1000 determines that the driver 1 should be warned, the fifth communicating means 35 communicates a fatigue alarm response signal to the driver 1 and informs the driver that the eye blink duration of the driver over time requires a change in conduct by the driver. The fifth communicating means 33 may, for example, include various fatigue alarm devices and a hardwire connection between the controller 1000 and those fatigue alarm devices. The fatigue alarm devices alert the driver 1 that the driver is falling asleep and that this impairs, or is about to impair, the driver's ability to safely operate the vehicle 100. The fatigue alarm devices may include a visual warning device such as a dashboard "Fatigue Alarm" light being illuminated or flashing, an auditory warning device such as a horn sounding off within the vehicle 100, and/or a tactile warning device such as a mechanism for vibrating the steering wheel, vehicle seat, and/or accelerator pedal.

Figure 5:
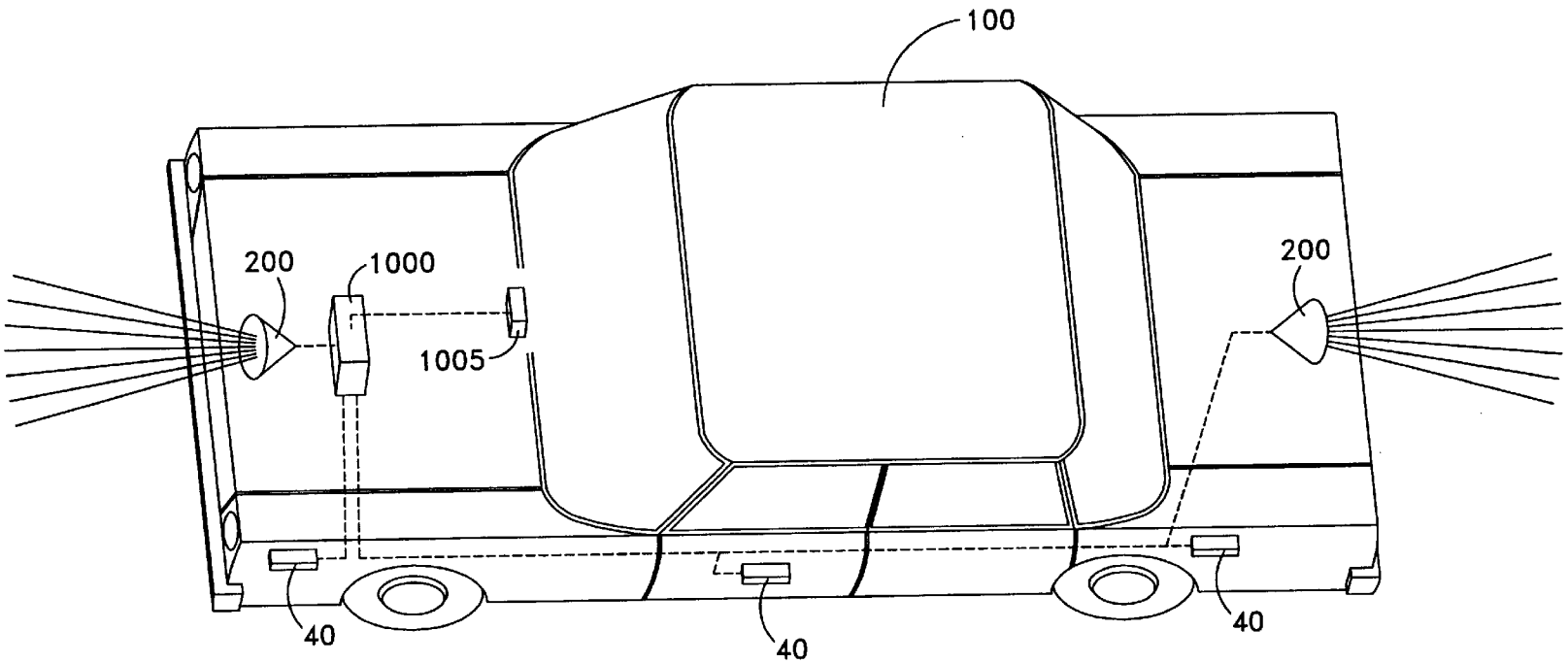
FIG. 5 is a schematic view of a vehicle in which part of the apparatus of FIG. 1 may be located.

The obstacle detection and collision avoidance system and operational event recording system with which the above apparatus 10 may operate includes a plurality of obstacle sensors 40 and receiver/transmitter modules (such as an antenna/microwave transceiver 200) that may be strategically located within the vehicle 100. As viewed in FIG. 5, one antenna/microwave transceiver 200 is located in the front of the vehicle 100 and one antenna/microwave transceiver 200 is located in the rear of the vehicle. Each of the sensors 40 and antenna/microwave transceivers 200 are electrically coupled to a controller, for example, the controller 1000. The controller 1000 includes a front end electronics section 300 and a digital electronics section 500. Each antenna/microwave transceiver 200 is associated with a front end electronics section 300.

Transceivers (not shown) may also be installed on the sides of the vehicle 100 to detect obstacles in the vehicle's "blind spot". Each of the sensors 40 independently collects information about the environment in which the vehicle 100 is operating.

Figure 2:
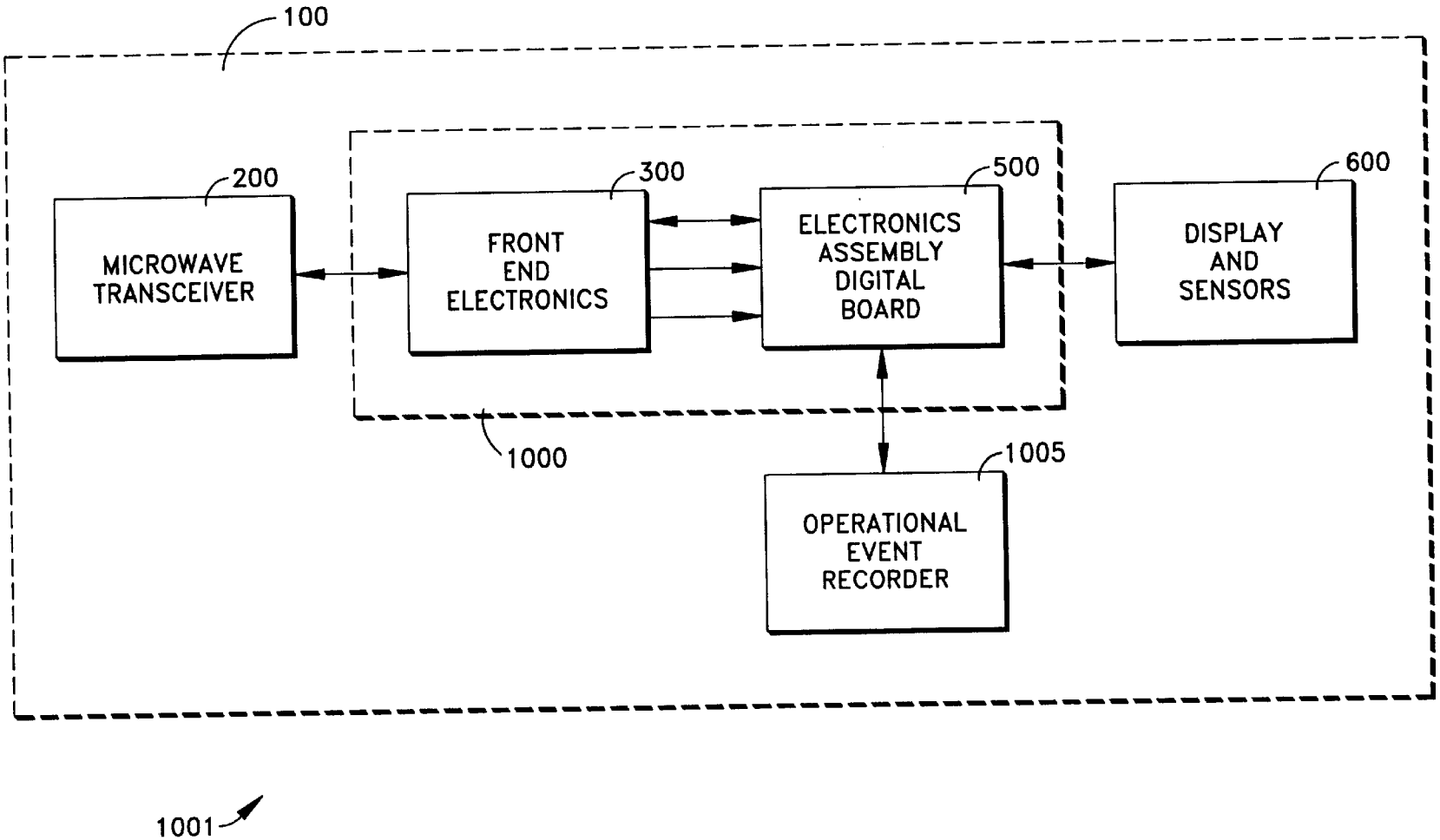
FIG. 2 is a simplified block diagram of a radar system that may be used in conjunction with the apparatus of FIG. 1.

FIG. 2 is a simplified block diagram of the radar system 1001 of this feature. The system 1001 detects objects (targets) in the environment surrounding the vehicle 100, determines the range and relative motion of each target with respect to the vehicle 100, and alerts the driver 1 of potential hazards that could result from the presence or motion of such targets.

The antenna/microwave transceiver section 200 of the system 1001 transmits and receives Radio Frequency (RF) signals. The controller 1000 compares received signals and transmitted signals. A difference signal is generated having a frequency equal to the difference between the frequency of the transmit and the receive signal. The difference signal is coupled to the front end electronics section 300. The front end electronics section 300 digitizes the difference signal. The digitized difference signal is coupled to the digital electronics section 500, which determines the range and relative motion of each target. The digital electronics section 500 is coupled to an input/output module, such as a display and sensor section 600. The display and sensor section 600 has a plurality of sensors that indicate to the system 1001 the status of various vehicle controls.

The display and sensor section 600 also produces audio, visual, and/or tactile indications for presentation to the driver 1 similar to the third, fourth, and/or fifth communicating means 33, 34, 35, discussed above. The radar system 1001 is capable of determining the rate at which a target is approaching, or retreating, and the distance to a plurality of different targets. The radar system 1001 may also determine the special relationship of the vehicle 100 to the roadway (i.e., whether the vehicle is centered within an appropriate travel lane and/or whether the roadway is straight or curved with a radius of curvature).

A removable, externally readable, non-volatile, solid-state memory event recording apparatus, such as ERA 1005, may be coupled to the controller 1000. The ERA 1005 may alternatively be an internal part of the controller 1000, as viewed in FIG. 6. The ERA 1005 records the output of each of the sensors 40 and information about targets detected by the radar system 1001. The ERA 1005 may use digital signal processing in conjunction with the apparatus 10 and the radar system 1001. The radar system 1001 and ERA 1005 are referenced by way of example, but the apparatus 10 could be readily adapted to be used in conjunction with other radar systems and ERA's.

Using the ERA 1005 in conjunction with the radar system 1001, as well as the controller 1000, allows recording of important data relating to obstacles in the path of the vehicle 100 that were detected by the radar system. This type of information may be useful in accident reconstruction, as well as in determining a driver's ability to safely operate the vehicle 100. The driver's performance in avoiding these obstacles may also be recorded and incorporated into the evaluation, by the controller 1000, of the driver's fitness to safely operate the vehicle 100.

Figure 3:
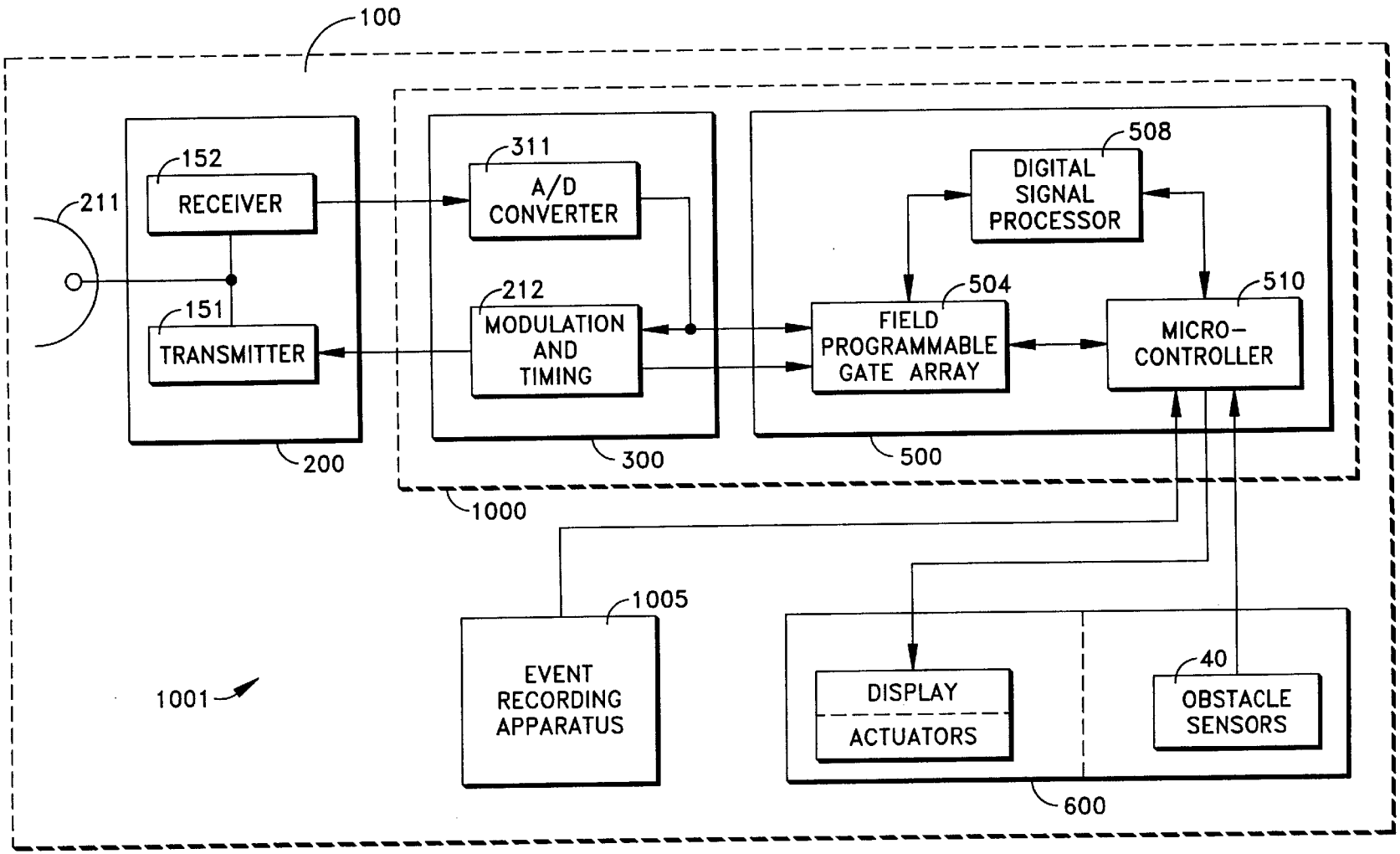
FIG. 3 is a detailed block diagram showing the radar system of FIG. 2.

Referring to FIG. 3, the antenna/microwave transceiver 200 of the radar system 1001 transmits a radar signal from a radar transmitter 151 via a radar antenna 211, and receives reflected Doppler shifted radar echoes in a receiver 152 through the antenna 211. The controller 1000 is coupled to the antenna/microwave transceiver 200 and contains a modulation and timing circuit 212 that controls the transmission of the radar signal and an A/D converter 311 for converting the received echo signal into a digital data stream. The modulation and timing circuit 212 and the A/D converter 311 may be part of the front end electronics 300 of FIG. 2. The controller 1000 further includes a signal processing module (such as the digital electronics section 500 of FIG. 2). The signal processing module 500 includes a digital signal processor (DSP) 508, a microcontroller 510, and a field programmable gate array 504, configured to control the flow of digital radar data to the DSP 508 under the control of the microcontroller 510. The signal processing module 500 is also coupled to the display and sensor section 600.

The display and sensor section 600 provides information from the sensors 40 to the microcontroller 510 for use in calculating a hazard level. The hazard level is presented by targets indicated from the received radar signal.

The digital electronics section 500 generates information from the transmitted and received radar signal, such as the closing rate (CR) of a target with respect to the vehicle 100, the distance (D) of various targets, and the direction of movement (towards or away from) of the targets with respect to the vehicle. The display and sensor section 600 has a display for indicating to the driver 1 an alarm (for example, flashing a dashboard "Collision" warning light to the driver 1 if a another vehicle is approaching too rapidly, and/or, in extreme conditions, automatically activating the vehicle brakes and/or air bag or disabling the vehicle 100). The communicating means 31, 32 described above may be utilized here, as well.

In operation, the radar system 1001 communicates information to the microcontroller 510 from the DSP 508. The microcontroller 510 calculates the range and relative speed of each target. The determination of the relative speed and distance is directly calculated by multiplying the frequency and phase difference by fixed factors, since the phase is linearly proportional to distance to (or range of) the target according to the formula:

$$R=C(\theta_1-\theta_2)/(4\pi(f_1-f_2)).$$

In the range formula, R is the range in feet, C is the speed of light in feet/second, $f_1$ is the frequency of a first channel signal, and $f_2$ is the frequency of a second channel signal. Frequency is linearly proportional to the relative speed of the target according to the formula:

$$f_d=72(Hz\cdot\text{hours/mile})\times V(\text{miles/hour})$$

In the relative speed formula, $f_d$ is the frequency shift due to the Doppler phenomenon, and V is the relative velocity of the target with respect to the transceiver 200. However, other means to map the frequency to a relative speed and the phase relationship to range may be used. For example, a table, stored in the controller 1000, may be used to cross-reference frequency and phase to relative speed and distance, respectively.

If the data is not within selected preset limits, it is deemed to be invalid and is disregarded. If the data is within the preset limits, the microcontroller 510 compares the new target range and relative speed with ranges and relative speeds previously recorded. If the range and relative speed of a target is consistent with the range and relative speed of a previously recorded target (i.e., if the difference between the range and speed of a new target and the range and speed of a previously recorded target is within a predetermined amount), the microcontroller 510 updates the range and relative speed previously recorded with the newly received range and relative speed. If the new target does not correspond to an existing target, the range and relative speed are stored and a new target is thus defined.

When the microcontroller 510 fails to receive data that closely matches a previously recorded target, the previously recorded target is assumed to have left the environment and the range and relative speed are dropped from the record. Thus, the radar system 1001 identifies and tracks a multiplicity of targets concurrently.

The microcontroller 510 may employ a target priority system, for example, to determine which one of the multiplicity of targets presents the greatest hazard level. The radar system 1001 will then assign a hazard priority and alert the driver 1 with the appropriate level of urgency (i.e., flash the "Collision" warning light with greater frequency). The radar system 1001 continues to track and reevaluate the hazard priority assigned to each target. If the range and relative speed of an older target fails to be similar to the range and relative speed of newer targets, the radar system 1001 discontinues tracking the old target while continuing to track each of the remaining targets. A hazard algorithm may be used which is as simple as alerting the driver 1 that a target is present within a range of 500 ft. More sophisticated algorithms may alternatively be used.

In the context of the obstacle detection and collision avoidance system, the controller 1000 controls indicators and/or controls various aspects of vehicle operation (for example, flashing a dashboard warning light to the driver 1 if the vehicle 100 is approaching too rapidly, and/or, in extreme conditions, automatically activating the vehicle brakes and/or air bag).

The apparatus 100 may utilize appropriately selected outputs from the sensors 40, the first and second sensing means 11, 12, and the radar system 1001, which have been recorded in the ERA 1005 (which may include the outputs recorded during past and present trips), to develop a profile of the driver 1. The driver's performance over a period of time is compared to a standard derived from the personal profile calculated using the driver's past performance. The results of the comparison are used to partially determine the driver's current fitness to safely operate the vehicle 100.

If the driver's performance at any time during a trip is found to be below the personal standard calculated for that driver 1, the driver may be alerted that driving performance is not up to the driver's personal standard. If the driver's performance continues to degrade or does not improve, an indication of the driver's performance is communicated to a person at a location remote from the vehicle 100 to convey the health condition information from the first transmitting means 21, vehicle operation information from the second sensing means 22, and driver performance information from the event recording apparatus 1005 to enable the remote person to determine a suitable type of response. The remote person may be a police dispatcher or an EMS operator. If the driver's performance degrades still further, the remote person may transmit a signal to the controller 1000 to cause the vehicle 100 to cease operating, after a sufficient warning is provided to the driver 1 that such action is imminent. If an extremely hazardous situation exists, the remote person may also immediately transmit a signal to the controller 1000 to manually shut down the vehicle 100 from the remote location. Each step of the process, along with the data that is collected at each step of the process, is recorded in the ERA 1005.

In addition to the information that is gathered by the sensors 40, other information may also be gathered by the apparatus 10. The controller 1000 may determine that the noise floor is above a selected threshold value. An assumption is then made that there is RF interference with the transmitting means 21, 22 at one or more of the transmit frequencies. In such a case, for example, the controller 1000 would send a command to the ERA 1005 to flush the data that has thus far been stored and restart the recording. In addition, the microcontroller 510 may command a frequency voltage generator to change the level of the voltages applied to a Gunn diode, thereby changing the transmit frequency.

The first output signal 110 from the first sensing means 11, the second output signal 120 from the second sensing means 12, and output signals from the sensors 40 provide information which is used to determine whether there is a danger present and/or to alter the factors used to compute a hazard level. For example, if the controller 1000 determines that the windshield wipers of the vehicle 100 have been turned ON, thus indicating a rain condition, the preferred following distance utilized by the radar system 1001 for targets may be lengthened to account for longer stopping distances on a wet road. Additionally, the power output by the first and second transmitting means 21, 22 may be increased to compensate for the attenuation caused by rain or snow conditions.

If a danger is present, the controller 1000 may activate an appropriate warning. The level of the danger may, for example, be based upon brake lag, brake range, vehicle speed, closing rate, target distance, and the reaction time of the operator. An average reaction time may be used. However, the controller 1000 could request the driver 1 to perform various exercises to establish the particular reaction time of the driver at the time that a trip begins. Alternatively, the driver's reaction to events that occur throughout a trip, stored in the ERA 1005, may be used to determine the reaction time of the driver 1. It should be understood that a wide variety of methods for warning the driver 1 of danger may be used, such as inducing vibration in the steering wheel, pedals, or other vehicle controls, such that the vibration increases as the level of the warning increases, and/or activating an audible tone that increases in pitch or volume as the level of the warning increases, as discussed above.

Figure 6:
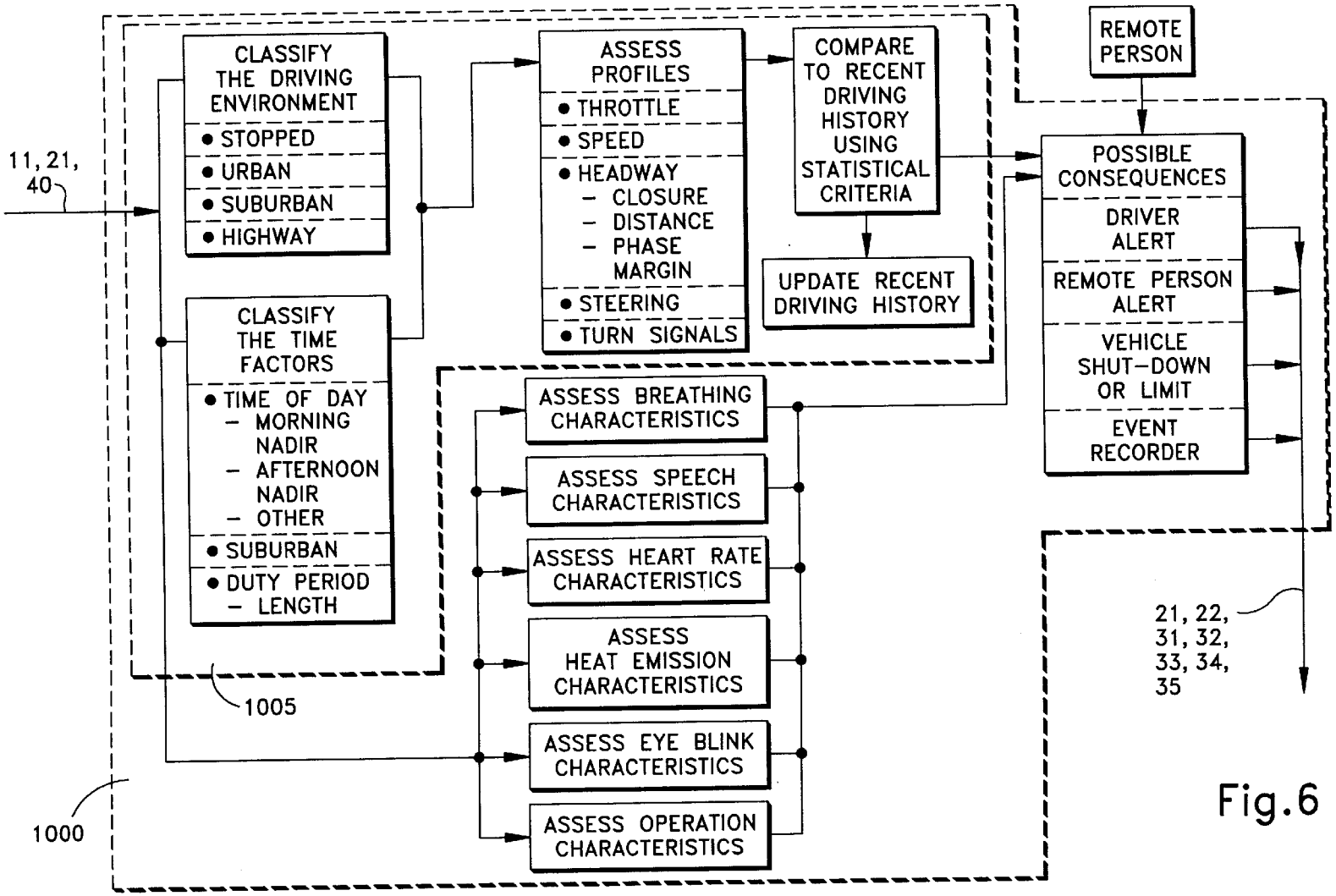
FIG. 6 is a flow chart of one possible fitness algorithm used to determine the fitness of a vehicle driver in accordance with the present invention.

In operation, as viewed in FIG. 6, the information recorded in the ERA 1005 is assessed by the controller 1000 and applied to a fitness algorithm which (1) generates a personalized performance standard for the driver 1; and (2) compares the driver's performance over a recent, and relatively short, period of time to the personalized performance standard.

As viewed in FIG. 4, the driving environment may, for example, be classified by determining whether the vehicle is (1) stopped, (2) in an urban environment, (3) in a suburban environment, or (4) on an open highway. In the present example, environmental classification is determined using speed. Thus, if the speed is 0 mph, then the vehicle 100 is determined to be stopped. An urban environment is determined if the speed is within the range of 0–35 mph. A suburban environment is determined if the vehicle speed is in the range of 35–45 mph. Finally, a highway environment is determined if the speed exceeds 45 mph.

In addition to classifying the environment, certain time factors may be classified. The time factors include time of day (morning nadir, afternoon nadir, or other), trip length, and duty period as determined by length. The fitness algorithm classifies time factors, inasmuch as accidents may be more likely to occur during the early morning, pre-dawn hours, and during the mid-afternoon hours. In particular, when the end of a long trip or a long duty period occurs in conjunction with such time periods, the risk of an accident usually rises.

Certain profiles may then be generated. These profiles include characterizations of the history of the throttle, speed, headway (closure, distance, and phase as determined by margin), steering, headlights, windshield wipers, and/or turn signal use. The throttle profile may be determined in accordance with mean value and variability thereof, as is the speed profile. The headway profile may include: (1) the rate at which the vehicle 100 approaches obstacles, including other vehicles (i.e., closure); (2) the vehicle speed; (3) how smoothly the vehicle accelerates, decelerates, and closes on obstacles (i.e., jerk); (4) the sustained distance between the vehicle 100 and other vehicles, determined in terms of mean value and variability; (5) "phase margin" (i.e., a measure of the driver's reserve capacity to respond safely to particular conditions that might arise); and (6) headlights and windshield wipers may be monitored since they are indications of poor visibility and road conditions. The steering profile may be generated by monitoring the median frequency shifts, in other words, the variations in lane position. The frequency and amplitude of steering changes, correlated to the vehicle speed, may provide a simplistic means for determining lane position. Lane position is usually an important profile in determining driver fitness. The steering profile may be generated by monitoring median frequency shifts. Other more sophisticated methods may also be used. For example, the relative position and motion of other vehicles detected by the radar system 1001 may be used.

As viewed in FIG. 4, the various profiles may be used in conjunction with the various driving environments. Thus, when the vehicle 100 is stopped, the controller 1000 and/or the ERA 1005 may assess the throttle position, the number of times the driver 1 blinks his eyes, and duration of each such blink. Turn signals and the secondary tasks may not be included in the assessment when the vehicle 100 is not moving. However, the turn signals may be included when the vehicle 100 is stopped. The speed, rate of closure, distance, phase margin and steering may not be applicable when the vehicle 100 is stopped.

At the other extreme, when the vehicle 100 is determined to be in a highway environment, all of the profiles listed in the table of FIG. 4 may be applicable. The urban and suburban environments may utilize selected ones of the profiles to the exclusion of others, as shown in the table.

If the vehicle 100 is determined to be in a highway environment, secondary task performance may be assessed. Lapses in response, such as substantial decreases in reaction time, are considered by the present invention to indicate drowsiness on the part of the driver.

The eye blink duration of the driver 1 is also assessed by the apparatus 10. This may, for example, be accomplished by covert digitized video scanning for eye blinks longer than 200 msec in duration, as discussed above. This assessment may be used in all of the driving environments. Long duration eye blinks are usually interpreted as indicating a state of drowsiness on the part of the driver.

A performance distribution curve may be generated which indicates the level of a driver's performance at any one time with relation to his performance at another time. The driver's recent driving history may be used to generate short term profiles and to evaluate current secondary task performance. Driver patterns that show a driver's recent performance to be at the less desirable ends of that particular driver's performance distribution curve indicate a need for caution by the driver 1.

The recent history of the driver 1 is updated. This updating is accomplished using new data derived from earlier steps.

As viewed in FIG. 6, one or more of the possible consequences of the data evaluation are then selected. The possible consequences include alerting the driver 1, a remote person (along with specific health condition information and vehicle operation information), shutting down or limiting the operation of the vehicle 100, and event recording. Upon determining that the driver 1 is operating below the personalized standard associated with that driver, the controller 1000 indicates that determination to the driver. Having been alerted to the fact that the driver's performance is below the calculated standard, the driver 1 has a predetermined amount of time to raise the level of performance to the level of the calculated standard.

If the driver 1 is not performing at the required level at the end of the predetermined period, the controller 1000 transmits a message to the remote person at the remote location who is responsible for ensuring the safety of the driver and vehicle 100. If the driver's performance does not improve a required amount within a predetermined amount of time after the message is transmitted, a warning is presented to the driver indicating that a shut-down of the vehicle 100 is imminent after a predetermined time. The amount of time until the shut-down will occur is communicated to the driver 1. Additionally, both strong visual and audio warnings may be given to the driver 1 to ensure that the driver is aware of the impending shut-down. The shut-down can be implemented as a gradually increasing inability to maintain speed, thus allowing the driver 1 to find a safe location to park the vehicle 100. A remote shut-down disable may be provided which permits the remote person, responsible for the safety of the driver 1 and vehicle 100 to override the shut-down for limited periods to afford the driver additional time to find an appropriate place to park the vehicle. Each action taken in accordance with the fitness algorithm is recorded on the ERA 1005, along with the continuing stream of information from the sensors 11, 12, 40 and the radar system 1001.

As another example, in order to enforce mandatory rest stops, the controller 1000 could be programmed to independently disable the vehicle 100 for a fixed period of time after a stop or until an authorization code is provided by the remote person (such a code could be provided to the controller 1000 by means of a 10-key keypad). Also, the remote person may have the capability to immediately shut down the vehicle 100 at any time.

It should be understood that the apparatus 10 may be used in conjunction with any microcontroller-based or microcomputer-based automotive electronic system that gathers data about various vehicle performance and environment factors and can control the loading of such information into a memory device. It will be understood that various modifications may be made without departing from the spirit and scope of the invention. For example, the number of sensors that are used to collect information regarding the vehicle, driver, and environmental conditions may be far less than those that have been cited herein. Also, the invention is not limited to only those sensors that have been listed herein. Furthermore, the number and type of responses to a driver's failure to meet the personal standard established for that driver are not limited to those cited herein. Nor are the particular responses cited herein required as a part of the present invention. Further, the standard may be determined by a method other than the method recited herein. For example, a system in which a standard that applies equally to all drivers would be within the scope of the present invention. Still further, any method for recording the events and conditions could be used in the present invention. Thus, the ERA described herein is provided as an example and need not be present in the form described. No radar system is required in the present invention, but is disclosed as an example of a means for collecting information regarding the environment in which the vehicle and driver are operating. Accordingly, it is to be understood that the inventive apparatus 10 is limited only by the scope of the appended claims.

Once the vehicle 100 is shut down, the remote person may utilize the health condition and vehicle operation information from the controller 1000 to respond in other suitable ways, such as sending a tow truck, EMS unit, fire truck, coroner, and/or police unit to the location of the vehicle. A known Global Positioning System (GPS) may be used for communicating the position of the vehicle 100 to the remote person at any given time.

In accordance with the present invention, a method for helping to protect the driver 1 of the vehicle 100 may include following steps: sensing at least one health condition of the driver 1; producing a first output signal 110 indicative of the health condition of the driver 1; sensing operational characteristics of the vehicle 100 over time; producing a second output signal 120 indicative of the operation of the vehicle 100 over time; and transmitting a health condition signal derived from the first output signal 110 and a vehicle operation signal derived from the second output signal 120 to a person at a location remote from the vehicle 100 to convey health condition and vehicle operation information to the person and to enable the person to determine a suitable type of response.

The method may further include the following steps: communicating the health condition signal derived from the first output signal 110 to the vehicle 100; communicating the vehicle operation signal derived from the second output signal 120 to the vehicle 100; and altering the operational characteristics of the vehicle 100 in response to the health condition signal and the vehicle operation signal.

The method may still further includes the following steps: communicating an alarm signal derived from the first output signal 110 to the driver 1; and informing the driver 1 that the health condition of the driver 1 requires a change in conduct by the driver.

The method may still further yet include the following steps: communicating an alarm signal derived from the second output signal 120 to the driver 1; and informing the driver 1 that the operation of the vehicle 100 over time requires a change in conduct by the driver 1.

The health condition sensing step may include sensing audible characteristics driver 1 such as breathing characteristics, speech characteristics, and heart rate characteristics. The health condition sensing step may further include sensing the heat emission characteristics of the vehicle occupant by use of an infrared sensor. The method may also include the step of sensing eye blink duration of the driver 1 by use of a visual sensor.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for helping to protect an occupant of a vehicle, the apparatus comprising:

means for non-intrusively sensing at least one health condition of the occupant of the vehicle and for producing a first output signal indicative of the health condition of the vehicle occupant;

a controller operatively connected to the means for non-intrusively sensing at least one health condition of the occupant and for receiving the first output signal, the controller analyzing the first output signal and outputting a health condition signal that indicates the at least one health condition of the occupant;

transceiver means for transmitting the health condition signal to a person at a location remote from the vehicle to enable the person to determine a suitable response, the transceiver means further being adapted for receiving and communicating a response signal from the person at the remote location to the controller; and at least one control device connected to the controller so as to be responsive to both the health condition signal and the response signal for altering at least one operational characteristic of the vehicle.

2. The apparatus as set forth in claim 1 wherein the at least one control device of the vehicle includes at least one of an ignition cut-off switch, an air bag actuation switch, a side curtain actuation switch, and a steering lock mechanism.

3. The apparatus as set forth in claim 1 further including:

means for communicating an alarm signal derived from the first output signal to the vehicle occupant for informing the vehicle occupant that the health condition of the vehicle occupant requires a change in conduct by the occupant.

4. The apparatus as set forth in claim 1 wherein the means for non-intrusively sensing includes an audio sensor for sensing audible characteristics of the vehicle occupant.

5. The apparatus as set forth in claim 4 wherein the sensed audible characteristics of the vehicle occupant include:

breathing characteristics, speech characteristics, and heart rate characteristics.

6. The apparatus as set forth in claim 1 wherein the means for non-intrusively sensing includes an infrared sensor for sensing a body temperature of the vehicle occupant.

7. The apparatus as set forth in claim 1 wherein the means for non-intrusively sensing includes a visual sensor for sensing eye blink duration of the vehicle occupant.

8. A method for helping to protect an occupant of a vehicle, the method comprising the steps of:

sensing at least one health condition of the occupant of the vehicle;

providing a first output signal indicative of the at least one health condition of the vehicle occupant to a controller;

analyzing the first output signal in the controller;

outputting a health condition signal from the controller;

transmitting the health condition signal to a person at a location remote from the vehicle to enable the person to determine a suitable type of response;

monitoring for a response signal from the person at the remote location and communicating the response signal to the controller; and altering at least one operational characteristic of the vehicle with at least one control device, the at least one control device being connected to the controller so as to be responsive to both the health condition signal and the response signal.

9. The method as set forth in claim 8 further including the step of:

communicating an alarm signal derived from the first output signal to the vehicle occupant for informing the vehicle occupant that the at least one health condition requires a change in conduct by the occupant.

10. The method as set forth in claim 8 wherein the step of sensing at least one health condition further includes the step of sensing audible characteristics of the vehicle occupant.

11. The apparatus as set forth in claim 10 wherein the step of sensing audible characteristics of the vehicle occupant further includes the step of sensing at least one of breathing characteristics, speech characteristics, and heart rate characteristics of the occupant with an audio sensor.

12. The method as set forth in claim 8 wherein the step of sensing at least one health condition further includes the step of sensing a body temperature of the vehicle occupant with an infrared sensor.

13. The method as set forth in claim 8 wherein the step of sensing at least one health condition further includes the step of sensing eye blink duration of the vehicle occupant by use of a visual sensor.

14. The method as set forth in claim 8 further including the following steps:

detecting obstacles external to the vehicle; and determining whether a collision by the vehicle with the obstacles is imminent.

15. The method as set forth in claim 8 further including the following steps:

recording the at least one operational characteristic of the vehicle; and developing a profile for defining a normal operating pattern the vehicle occupant.

16. An apparatus for helping to protect an occupant of a vehicle, the apparatus comprising:

means for non-intrusively sensing at least one health condition of the occupant of the vehicle and for producing a first output signal indicative of the health condition of the vehicle occupant;

a controller operatively connected to the means for non-intrusively sensing at least one health condition of the occupant and for receiving the first output signal, the controller analyzing the first output signal and outputting a health condition signal that indicates the at least one health condition of the occupant;

transceiver means for transmitting the health condition signal to a person at a location remote from the vehicle to enable the person to determine a suitable type of response, the transceiver means further being adapted for receiving and communicating a response signal from the person at the remote location to the controller;

at least one control device connected to the controller so as to be responsive to both the health condition signal and the response signal for altering at least one operational characteristic of the vehicle;

means for sensing the at least one operational characteristic of the vehicle and for producing a second output signal indicative of the at least one operation characteristic of the vehicle; and means for communicating a vehicle operation signal, which is derived in the controller from the second output signal, to the at least one control device, the at least one control device, in response to the vehicle operation signal, altering the at least one operational characteristic of the vehicle.

17. The apparatus as set forth in claim 16 further including:

means for transmitting the vehicle operation signal to the person at the location remote from the vehicle to enable the person to determine a suitable type of response, the means for transmitting the vehicle operation signal being operatively connected to the controller.

18. The apparatus as set forth in claim 16 further including:

means for communicating an alarm signal derived from the second output signal to the vehicle occupant for informing the vehicle occupant that the operation of the vehicle requires a change in conduct by the occupant.

19. A method for helping to protect an occupant of a vehicle, the method comprising the steps of:

sensing at least one health condition of the occupant of the vehicle;

providing a first output signal indicative of the at least one health condition of the vehicle occupant to a controller;

analyzing the first output signal in the controller;

outputting a health condition signal from the controller;

transmitting the health condition signal to a person at a location remote from the vehicle to enable the person to determine a suitable type of response;

monitoring for a response signal from the person at the remote location and communicating the response signal to the controller;

altering at least one operational characteristic of the vehicle with at least one control device, the at least one control device be connected to the controller so as to be responsive to both the health condition signal and the response signal;

sensing the at least one operational characteristic of the vehicle;

providing a second output signal indicative of the at least one operational characteristic to the controller;

analyzing the second output signal in the controller;

providing a vehicle operation signal from the controller to the at least one control device; and altering the at least one operational characteristic of the vehicle in response to the vehicle operation signal.

20. The method as set forth in claim 19 further including the step of:

transmitting the vehicle operation signal to the person at the location remote from the vehicle to convey the at least one operational characteristic to the person and to enable the person to determine a suitable type of response.

21. The method as set forth in claim 19 further including the step of:

communicating an alarm signal derived from the second output signal to the vehicle occupant for informing the vehicle occupant that the at least one operational characteristic of the vehicle requires a change in conduct by the occupant.

* * * * *